US009117645B2

(12) United States Patent
van Amerom et al.

(10) Patent No.: US 9,117,645 B2
(45) Date of Patent: Aug. 25, 2015

(54) PLANAR ION FUNNEL

(71) Applicant: SRI International, Menlo Park, CA (US)

(72) Inventors: Friso H. W. van Amerom, St. Petersburg, FL (US); Ashish Chaudhary, St. Petersburg, FL (US); R. Timothy Short, St. Petersburg, FL (US)

(73) Assignee: SRI International, Menlo Park, CA (US)

( * ) Notice: Subject to any disclaimer, the term of this patent is extended or adjusted under 35 U.S.C. 154(b) by 279 days.

(21) Appl. No.: 13/673,622

(22) Filed: Nov. 9, 2012

(65) Prior Publication Data

US 2013/0120894 A1 May 16, 2013

Related U.S. Application Data

(60) Provisional application No. 61/560,657, filed on Nov. 16, 2011.

(51) Int. Cl.
*H01T 23/00* (2006.01)
*H01J 49/06* (2006.01)

(52) U.S. Cl.
CPC ..... *H01J 49/066* (2013.01); *H01T 23/00* (2013.01)

(58) Field of Classification Search
USPC ..... 361/230
See application file for complete search history.

(56) References Cited

U.S. PATENT DOCUMENTS

| | | | | |
|---|---|---|---|---|
| 6,107,628 | A * | 8/2000 | Smith et al. | 250/292 |
| 8,907,272 | B1 * | 12/2014 | Wouters et al. | 250/288 |
| 2001/0037979 | A1 * | 11/2001 | Moon et al. | 210/656 |
| 2004/0195503 | A1 * | 10/2004 | Kim et al. | 250/288 |
| 2004/0251411 | A1 * | 12/2004 | Bateman et al. | 250/293 |
| 2005/0189486 | A1 * | 9/2005 | Fuhrer et al. | 250/287 |
| 2005/0258364 | A1 * | 11/2005 | Whitehouse et al. | 250/292 |
| 2006/0283171 | A1 * | 12/2006 | Metcalfe et al. | 60/202 |
| 2009/0218485 | A1 * | 9/2009 | Kaiser et al. | 250/283 |
| 2014/0034827 | A1 * | 2/2014 | Mordehai et al. | 250/283 |

* cited by examiner

*Primary Examiner* — Thienvu Tran
*Assistant Examiner* — Angela Brooks
(74) *Attorney, Agent, or Firm* — Beyer Law Group LLP

(57) ABSTRACT

A planar ion funnel is disclosed that can be used for ion control. In one application, the planar ion funnel can be used for ion control in a mass spectrometer. The planar ion funnel can be formed on a surface of a substantially planar substrate including an orifice. An electrically conductive structure can be formed on a top surface of the substrate that surrounds the orifice. In operation, a power can be applied to the conductive structure that causes an electric field to be generated that draws ions into and through the orifice. In one embodiment, the orifice can be circular and the conductive structure can be a series of nested rings of increasing diameter surrounding the orifice.

21 Claims, 5 Drawing Sheets

PLANAR ION FUNNEL

CROSS REFERENCE TO RELATED APPLICATIONS

This patent application claims priority under 35 U.S.C. §119(e) to U.S. Provisional Patent Application Ser. No. 61/560,657 entitled, "Planar Ion Funnel," filed Nov. 16, 2011, which is incorporated by reference in its entirety for all purposes.

FIELD OF THE INVENTION

The present invention is generally related to ion control in a low pressure environment. More particularly, the present invention is directed to providing an ion funnel for manipulating and focusing ions for applications such as mass spectrometry.

BACKGROUND OF THE INVENTION

In recent years, mass spectrometry has become an important analysis tool in the physical and biological sciences. Mass spectrometry is an analytical technique that is used primarily to determine masses of particles, an elemental composition of a sample or the chemical structure of a molecule. Mass spectrometry works by creating ions from a sample to generate charged atoms, molecules or molecule fragments and measuring their mass-to-charge ratios.

In many implementations of mass spectrometry, to achieve the maximum possible sensitivity, ions created at higher pressures need to be transmitted with high efficiency through narrow, conductance limiting apertures that separate differentially pumped vacuum chambers prior to reaching the high vacuum region of the mass analyzer. In the mass analyzer, ions are sorted by their masses by applying electromagnetic fields. Thus, the sensitivity of the instrument is directly related to how efficiently ions are transmitted to the mass analyzer. The ion transmission efficiency depends on the extent to which the motion of ions can be controlled in the different vacuum stages.

In the absence of background gas molecules (e.g., high vacuum), ions can be manipulated with extreme precision and in a well understood fashion using magnetic and electric fields. At elevated pressures (e.g., about 1 Torr and above), collisions with gas molecules increasingly dominate the behavior of ion motion and it becomes much more challenging to control ion motion over larger areas or volumes. For example, the high rate of collisions inhibits effective focusing of ions with static lens stack. Further, radio frequency-only multipoles exhibit either an acceptance area that is too small to efficiently capture ions from an expanding gas jet (for small inscribed radius) or an effective potential that is too weak to focus ions to a narrow conductance-limiting aperture (for large inscribed radius).

One approach to solving this problem is to use a skimmer as a conductance-limiting orifice to separate the first and the second vacuum chambers. However, the use of a skimmer causes only a small fraction of the ion cloud to be sampled, which reduces the efficiency of the ion transmission and creates a major sensitivity bottleneck for mass spectrometry. Another approach to solving the problem is to use an ion funnel.

A traditional ion funnel uses a series of closely spaced ring electrodes whose inner diameters gradually decrease, serving to radially confine ions as they pass through the funnel. The rings are arranged in a non-overlapping manner along an axial line, coincident with the direction of ion travel, to form a conic or funnel shape. In operation, an out-of-phase radio frequency potentials are applied to adjacent electrodes, and a dc gradient is typically applied in the direction of the axis of the ion funnel to drive ions through the device.

Ion funnels have been successfully implemented to improve the sensitivity of many mass spectrometer designs. However, there are some mass spectrometry applications where a traditional ion funnel configuration is not optimal. In view of the above, new methods and apparatus for ion control using an ion funnel are desired.

SUMMARY OF THE INVENTION

Broadly speaking the embodiments described herein relate to devices for ion control. For example, the devices can be used for performing ion control in mass spectrometry related applications. In particular, the ion control devices can be used to funnel ions into a mass analyzer for the purposes of performing mass spectrometry. In one embodiment, the ion control devices can be formed on a substantially planar substrate. Thus, as described herein, the devices can be referred to as planar ion funnels (PIFs).

PIFs, which are substantially planar, are more compact than traditional ion funnels, which are formed in 3-D conical shape. The planar nature of the PIF design may allow the dimensions of an instrument employing the PIF, such as a mass spectrometer, to be reduced resulting in a more compact instrument. A more compact instrument configuration may be important when space limitations are an issue. Further, the PIF design may be more amenable to MicroElectroMechanical Systems (MEMs) related manufacturing processes as compared traditional ion funnel designs because planar structures lend themselves better to the lithographic processes associated with MEMs than non-planar structures. This aspect of the PIF may allow mass spectrometry to be more easily applied to "lab on a chip" type applications. Finally, PIF can be operated using DC power which is more power efficient and may allow for simpler electronics than traditional ion funnel designs.

In one aspect of the embodiments described herein, a device for ion control in a low pressure environment is described. The device can be generally characterized as including 1) a substantially planar substrate; 2) a conductive layer formed on the planar substrate; 3) an orifice passing through the conductive layer and the planar substrate for receiving ions; 4) a structure for generating an electric field and connectors configured to receive power for supplying a voltage to the structure to generate the electric field. The structure can be formed in the conductive layer in an area surrounding the orifice such that when a voltage is applied to the structure an electric field is generated that extends above a top surface of the structure that either funnels ions in a space above the top surface towards and through the orifice or disperses the ions that pass through the orifice as the ions move away from the top surface. An insulative material can be used for the substrate that substantially reduces the electric field that passes through the substrate. In a particular embodiment, a pressure in the low pressure environment in the space near the device where the ions are travelling can be less than about 40 Torr.

In additional embodiments, an outer perimeter of the orifice can be circular. Further, an outer perimeter of the area including the structure that surrounds the orifice can be circular. When the voltage is applied to the structure, the voltage can increase from an outer perimeter of the orifice to an outer perimeter of the area including the structure that surrounds the orifice. In particular, the structure can be formed with a resistance that increases from an outer perimeter of the area including the structure that surrounds the orifice to an outer perimeter of the orifice such that when the voltage is applied to the structure a voltage gradient is generated where a minimum voltage occurs near the outer perimeter of the orifice and a maximum voltage occurs near the outer perimeter of the area, said voltage gradient generating the electric field for funneling the ions.

In a particular embodiment, the structure can include a plurality of discrete concentric rings formed in the conductive layer. A voltage divider circuit can be coupled to the discrete concentric rings so that a discrete and different voltage is applied to each of the plurality of concentric rings. The structure and/or the voltage divider circuit can be configured such that a minimum voltage is applied to the innermost of the plurality of concentric rings and a maximum voltage is applied to the outermost of the plurality of concentric rings. In one embodiment, the voltage can continually increase from the inner to the outer ring.

In yet other embodiments, the device can be formed on a printed circuit board. Alternatively, the device can be formed on a silicon wafer as a part of a MEMs device. In yet another embodiment, the device can be formed on a ceramic disk. The power utilized by the device can be DC power. In some instances, energy of the ions controlled by the device can be between about 1 and 5 Electron Volts.

Another aspect of the embodiments described herein can be generally characterized as a mass spectrometer. The mass spectrometer can include 1) an ion source for generating ions; 2) a mass analyzer for separating ions; 3) a detector for detecting ions that have passed through mass analyzer; 4) a planar ion funnel disposed between the ion source and the mass analyzer for funneling the ions generated in the ion source through an orifice in the planar ion funnel and towards the mass analyzer. The planar ion funnel can include i) a substantially planar substrate; ii) a conductive layer formed on the planar substrate; iii) a structure for generating an electric field where the structure can be formed in the conductive layer in an area surrounding the orifice such that when a voltage is applied to the structure the electric field is generated that extends above a top surface of the structure and funnels ions towards and through the orifice; iv) connectors configured to receive power for supplying a voltage to the structure so that the electric field is generated.

In other embodiments, the structure includes a plurality of discrete concentric rings. As an example, a maximum diameter of the plurality of discrete concentric rings can be between about 10 mm and 20 mm. A voltage divider circuit can be coupled to the rings such that a discrete and different voltage can be applied to each of the plurality of concentric rings to generate the electric field. The voltage applied to the structure can be between 900 and 300 volts. The power used to generate the electric field can be DC power.

Yet another aspect can be generally characterized as a planar ion funnel (PIF) for ion control in a low pressure environment. The PIF can include 1) a substantially planar substrate, 2) a conductive layer formed on the planar substrate; 3) an orifice passing through the conductive layer and the planar substrate for receiving ions; 4) a structure for generating an electric field including a plurality of concentric rings formed in the conductive layer that surround the orifice such that when a voltage is applied to the structure the electric field is generated that extends above a top surface of the structure that funnels ions towards and through the orifice; 5) connectors configured to receive power for supplying a voltage to the structure to generate the electric field; and 6) a voltage divider circuit for providing a different portion of the supplied voltage to each of the plurality of concentric rings.

Other aspects and advantages will become apparent from the following detailed description taken in conjunction with the accompanying drawings which illustrate, by way of example, the principles of the invention.

DETAILED DESCRIPTION

In the following paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

Traditional ion funnels have been primarily developed to improve the sensitivity of mass spectrometers. In the mass spectrometer, an ion funnel receives ions from an ion source where components of a sample to be analyzed are ionized. The entrance and the exit to the ion funnel are typically circular where the area of the entrance is larger than the exit. Between the entrance and exit, the funnel includes a number of circular rings of a decreasing area. When joined, the circular rings provide a 3-D conical shape. Out-of-phase RF potentials are applied to alternate rings to drive and concentrate the ions along the length of funnel until the ions pass through the exit. The ions can pass through the exit in a beam-like manner where the width of the beam relates to the width of the exit.

Figure 1:
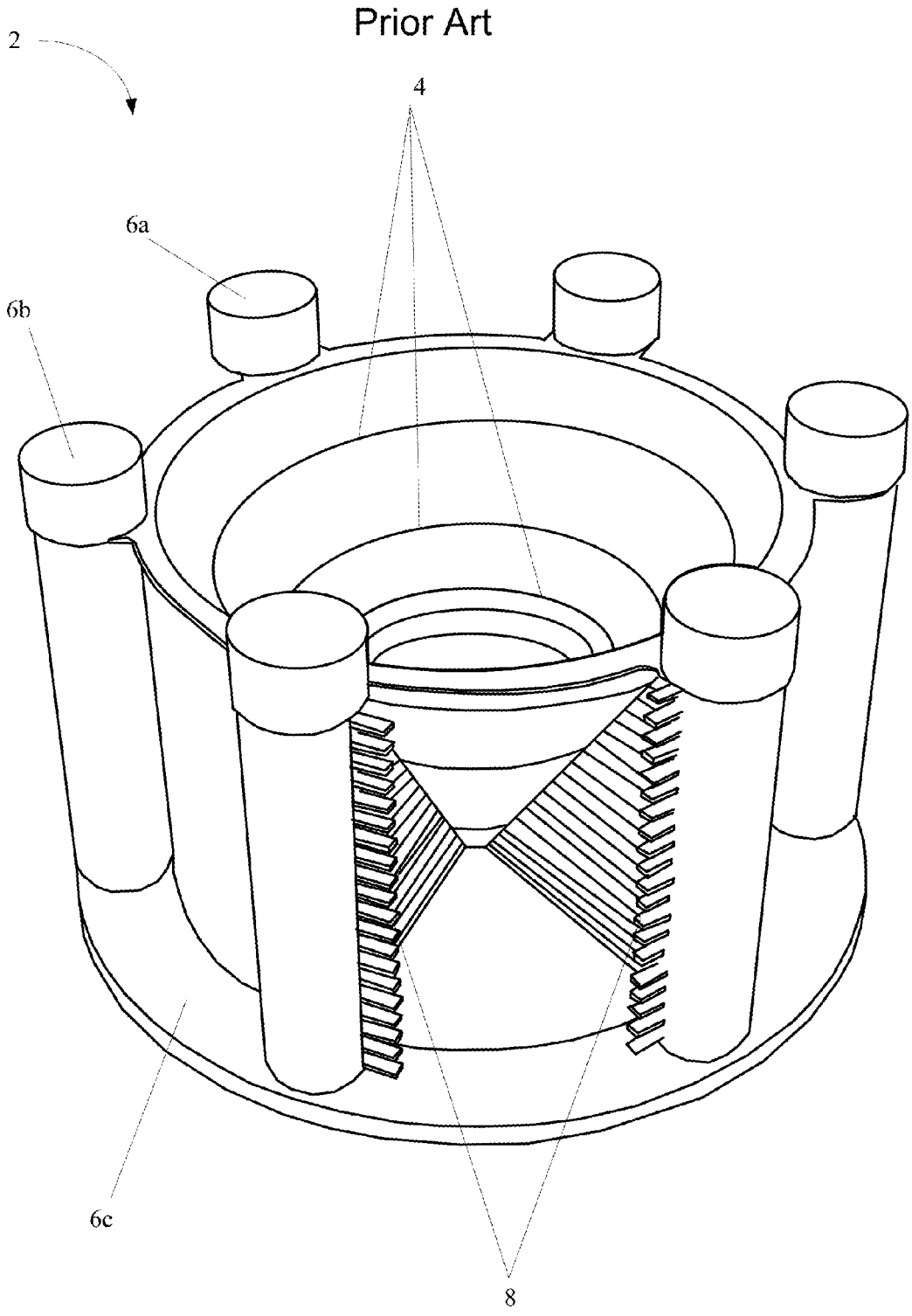
FIG. 1 is a perspective drawing of a prior art ion funnel.

FIG. 1 shows a perspective drawing of a traditional ion funnel 2. The ion funnel includes a number of rings of decreasing diameter stacked on top of one another in a three-dimensional structure. A support structure, such as 6*a*, 6*b* and 6*c*, holds the rings in place and allows the device to be mounted to a test apparatus. Electrodes 8 are provided that allow power to be applied to the various rings in operation. Typically, in operation, an RF voltage is applied to each ring where the phase of the voltage alternates from ring to ring.

When mass spectrometry is performed in a laboratory setting, issues, such as the size of the mass spectrometer and its power consumption, are typically not issues. However, there are mass spectrometer applications where space limitations and power consumption are issues. For example, space and power consumption can be important for portable devices used to perform mass spectrometry. As another example, space and power consumption limitations are important when applying mass spectrometry in space exploration applications, such as when incorporating a mass spectrometer into a satellite as is described in more detail below.

As is described in more detail as follows, planar ion funnels are described. In a planar ion funnel (PIF), an electric field is generated that has the effect of funneling ions towards an aperture in the PIF. However, unlike traditional ion funnels that are 3-D shaped (e.g. see FIG. 1), the structure of the PIF is substantially planar-shaped. The planar shape may allow instruments using a PIF to be made more compact as compared to instruments using a traditional ion funnel. In addition, the planar devices may be easier to construct because it is not necessary to align a large number of rings in a 3-D structure. Further, the electric field that is needed for funneling can be generated using DC power, which allows for lower power consumption as compared to traditional ion funnels. Thus, the PIFs described herein may be suitable for applications utilizing an ion funnel where compactness and power consumption are important.

Planar ion funnels are described in more detail with respect to the following figures. In particular, with respect to FIG. 2, a mass spectrometer including a PIF is described. In FIG. 3, a general configuration of a PIF is discussed. With respect to FIG. 4, a side view and top view of a PIF during ion control including an illustration of the electric field generated by the PIF is discussed. Top and bottom perspective drawings of a PIF design in accordance with one embodiment are described with respect to FIGS. 5A and 5B. The PIF is implemented on a printed circuit board. With respect to FIG. 6A is a block diagram of an experimental set-up for testing operation of a planar ion funnel is described. The experimental set-up is used to test the operation of one particular planar ion funnel design. Finally, in FIG. 6B a plot of flux versus time when different voltages are applied to the planar ion funnel shown in the experimental set-up of FIG. 6A are shown. The fluxes illustrate the ion funneling effect that is generated by the PIF.

Figure 2:
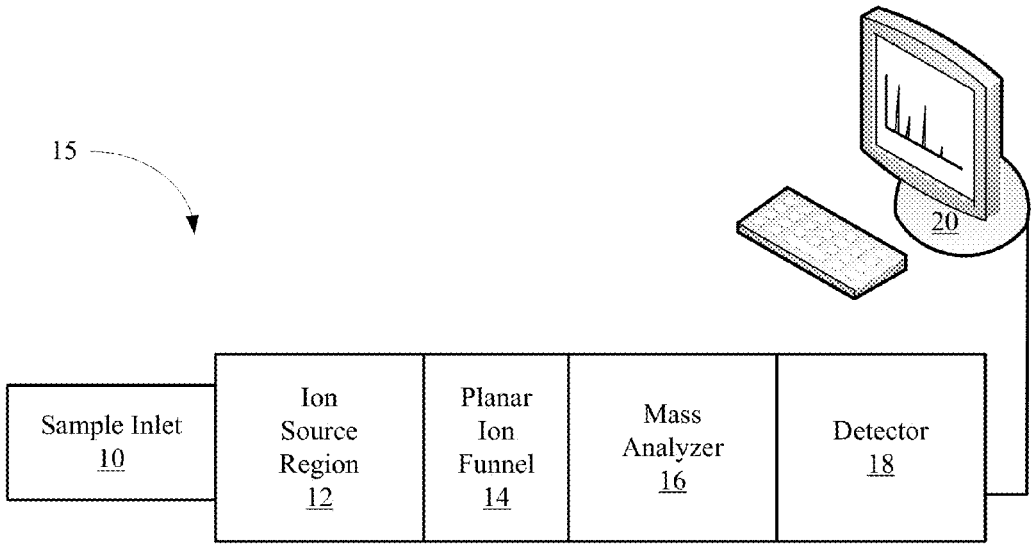
FIG. 2 is a block diagram of a mass spectrometer including a planar ion funnel in accordance with an embodiment of the present invention.
Figure 3:
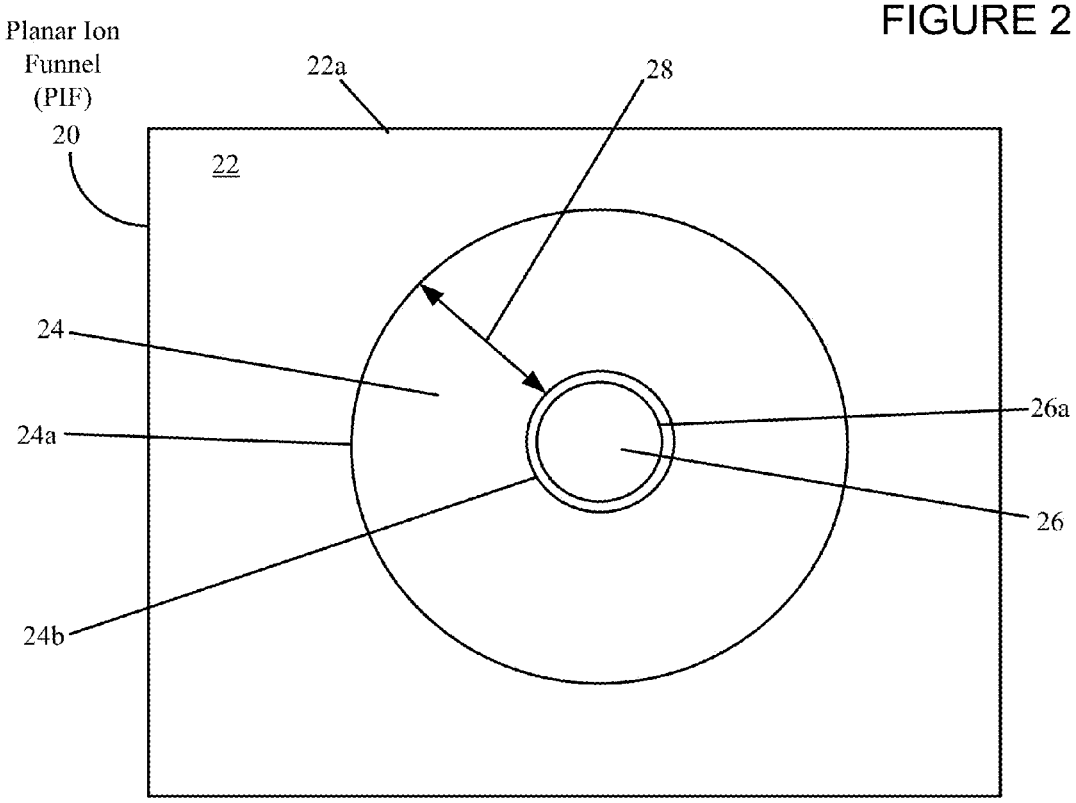
FIG. 3 is a block diagram of a planar ion funnel in accordance with an embodiment of the present invention.

FIG. 2 is a block diagram of a mass spectrometer 15 including a planar ion funnel 14. An implementation of a PIF 14 in a mass spectrometer is described for the purposes of illustration only and is not meant to be limiting. In a general, a PIF can be utilized in many different types of applications that require ion control. Further, depending on the application, the PIF can be used to control any type of charged particle, both negatively or positively charged, as well as mixtures of negatively and positively charged particles.

In FIG. 2, a sample to be analyzed can be introduced to the mass spectrometer via the sample inlet 10. The sample may include a number of different chemical compounds. If needed, the introduced sample can be vaporized. In the ion source region 12, all or a portion of the gaseous sample can be ionized to generate charged molecules or molecule fragments. There are many different methods for ionizing a sample. One typical method for ionizing a sample is to provide an electron source that generates excess electrons. The excess electrons can be passed through the sample to ionize the sample components. Depending on the source, negative or position ions can be created.

The PIF 14 can be situated adjacent to the ion source region 12. In one embodiment, the PIF can be configured such that an electric field (see e.g., FIG. 4) extends from the surface of a PIF and into a region of space where ionized and gaseous portions of the sample generated in the ion source region 12 are located. The PIF can be configured such that the electric field draws ions towards the PIF.

The PIF 14 can include an orifice. A structure on the PIF surrounding the orifice can be used to generate an electric field that extends from the PIF. The electric field can be shaped such that the ionized portions of the sample, which can be spread out over an area that is larger than the orifice, are drawn towards and concentrated before passing through the orifice and into the mass analyzer 16.

In some applications, it may be desirable to disperse rather than concentrate a flux of ions. For example, an ion beam can be passed through the orifice of a PIF. A structure on the PIF can be provided that causes in operation the beam to spread out after passing through orifice. In some mass spectrometry applications, it is desirable to control ions in this manner. Thus, in general, for the purposes of ion control, a PIF can be configured to generate an electric field that concentrates or disperses a flux of ions by using the appropriate voltage polarity.

In the mass analyzer 16, a portion of the ions from the PIF can be captured. For instance, the mass analyzer can be configured to capture ions with a mass/charge ratio within a particular range. After the ions are captured in the mass analyzer, the ions can be discharged in some order from the mass analyzer, such that they impinge on the detector 18.

The detector 18 can be used to count a number of ions that impinge on the detector. The detector 18 can be coupled to a data analysis system 20. The data from the detector 18 can be output to the data analysis system 20. The data analysis system 20 can be used to generate, store and display a spectra associated with the sample analyzed in the mass spectrometer.

The PIF can be used in many different types of applications to provide different ion control functions. For example, the PIF can be used in liquid chromatography mass spectrometry, time of flight liquid chromatography mass spectrometry and time of flight gas chromatography to couple atmospheric ionization to low pressure regions. As another example, in ion mobility spectrometry, the PIF can be used to transport ions from a dispersed region to a region of high concentration. In yet another example, in ion mobility spectrometry and mass spectrometry, the PIF can be used to transport ions from a drift region to a mass analyzer.

In an additional example, in quadrupole mass spectrometry, the PIF can be used to transport ion flux from a higher pressure dispersed region to a trap for storage and mass analysis. In addition, in laser ablation mass spectrometry, the PIF can be used to transport ions from a plume of a sample ionized by a laser to other sensors for analysis. Further, in Fourier transform ion cyclotron resonance, the PIF can be used to transport ions from atmosphere to several stages of linear ion traps. Finally, in time of flight liquid chromatography ion mobility spectrometry, the PIF can be used to transport ions between the exit and the entrance of drift tubes.

The ion control functions described in the previous paragraphs can be used in other applications are not limited to only the applications that are described. In addition, the PIF can be used in other applications involving ion control that are not listed. Next, details of a PIF are discussed with respect to FIG. 3.

FIG. 3 is a block diagram of a planar ion funnel 20. The PIF includes a substrate 22. In one embodiment, the substrate material can have insulative properties such that an electric field generated by the PIF is substantially reduced when as it passes through the substrate. In another embodiment, an insulative layer can be added to the substrate between the conductive layer and the substrate or even on the side of the substrate opposite the conductive layer to perform this function.

An orifice 26 is formed through the conductive layer and the substrate 22 as well as any other intervening layers. The orifice includes an outer perimeter 26*a*. A structure 24 for generating an electric field that extends into the space above the conductive layer can surround the orifice. The structure 24 can be formed in the conductive layer. The structure 24 can include an outer perimeter 24*a* and an inner perimeter 24*b*. The area of the structure 24 is the area between the inner and outer perimeters. In one embodiment, the inner perimeter 24*b* of the structure 24 can be coincident with the outer perimeter 26*a* of the orifice. However, as shown in FIG. 3, the inner perimeter 24*b* of the structure 24 is not coincident with the outer perimeter 26*a* of the orifice 26*a*.

In one embodiment, the conductive layer may almost entirely cover the substrate 22. In other embodiments, the conductive layer may not entirely cover the substrate. For example, the conductive layer may extend only to an outer perimeter of the structure 24 and/or some distance beyond the outer perimeter but may not entirely cover the substrate 22 all the way to the outer perimeter 22*a*. As another example, the conductive layer may not cover the area of the substrate 22 between the inner perimeter 24*b* of the structure 24 and the outer perimeter 26*a* of the orifice.

In the example of FIG. 3, the outer perimeter 26*a* of the orifice, the inner perimeter 24*b* of the structure and the outer perimeter 24*a* of the structure 24 are all shown as circular. In other embodiments, any one of these perimeters can be formed from general curves or polygons that are non-circular and/or asymmetrically shaped around a center of the orifice 26. For example, the outer perimeter 24*b* can square-shaped, oval-shaped or triangularly shaped. Further, each of the perimeters can have a shape different from one another. For example, the outer perimeter 26*a* of the orifice 26 can be triangular, the inner perimeter 24*b* of the structure can be circular and the outer perimeter of the 24*a* of the structure 24 can be square.

During operation, the structure 24 can be coupled to a power source. When power is supplied to the structure 24 a voltage gradient 28 is generated between the inner perimeter 24*b* and the outer perimeter 24*a*. For example, a maximum voltage can be generated near the outer perimeter and a minimum voltage can be generated near the inner perimeter 24*b*. The rate of increase of the voltage between the minimum and maximum voltages can vary. For example, the voltage can increase linearly between the minimum and maximum voltage across the surface of the structure 24. In another example, the voltage can increase geometrically between the maximum and minimum voltages. As will be described in more detail with respect to FIG. 4, the voltage gradient 28 can be shaped such that an electric field is generated which causes ions to be funneled towards toward the PIF 20 and through the orifice 26 in the PIF 20.

How the voltage varies from the inner perimeter to the outer perimeter can affect how quickly ions are drawn to the inner perimeter. It may not be desirable to draw ions too quickly towards to the inner perimeter because the ions may then overshoot a center axis that passes through the orifice. In particular embodiments, the distribution of voltage across the structure 24 and resulting voltage gradient can be tailored to mitigate this effect.

Figure 4:
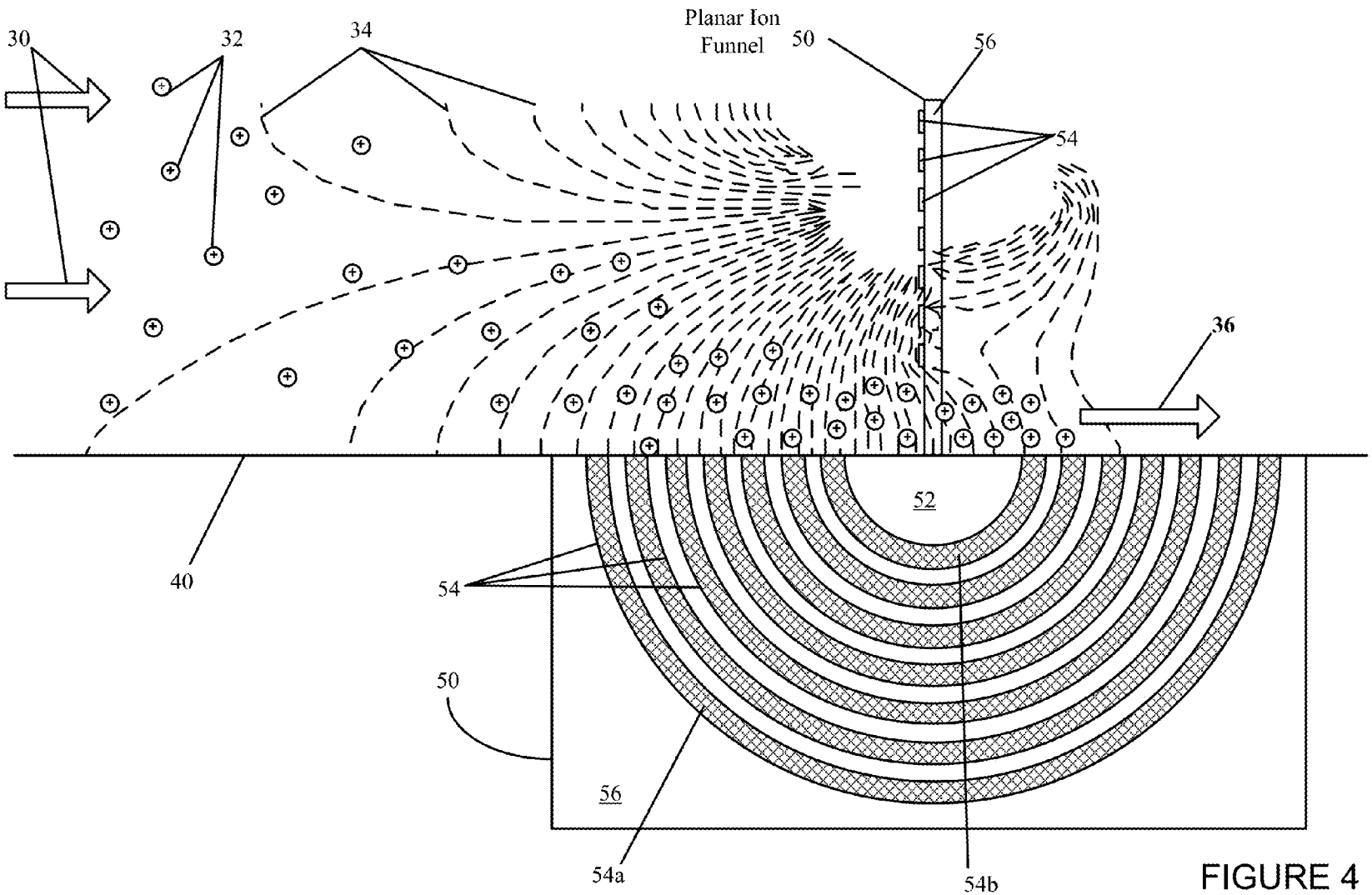
FIG. 4 is diagram including a side view and top view of a planar ion funnel during ion control in accordance with an embodiment of the present invention.

FIG. 4 is diagram including a side view and top view of a planar ion funnel 50 during ion control. The top portion of FIG. 4 shows the side view of the PIF 50 and the equipotential field lines 34 generated by the PIF. The bottom portion shows a top view of the PIF 50.

In the bottom portion of FIG. 4, a structure including seven concentric rings 54 formed on top of substrate 56 is shown. When power is supplied to the structure, an electric field for funneling ions is generated. The seven concentric rings surround the orifice 52. The concentric rings are formed in a conductive layer on top of substrate 56. Material has been removed from the conductive layer to form the rings such that an insulative gap is provided between in each of the rings. The gap spacing between the rings is substantially the same. In other embodiments, the gap spacing can be varied between the rings. The number of rings is variable as well and the example of seven rings is provided for the purposes of illustration only. In alternate embodiments, more or fewer rings can be used for this type of PIF configuration.

Figure 5A:
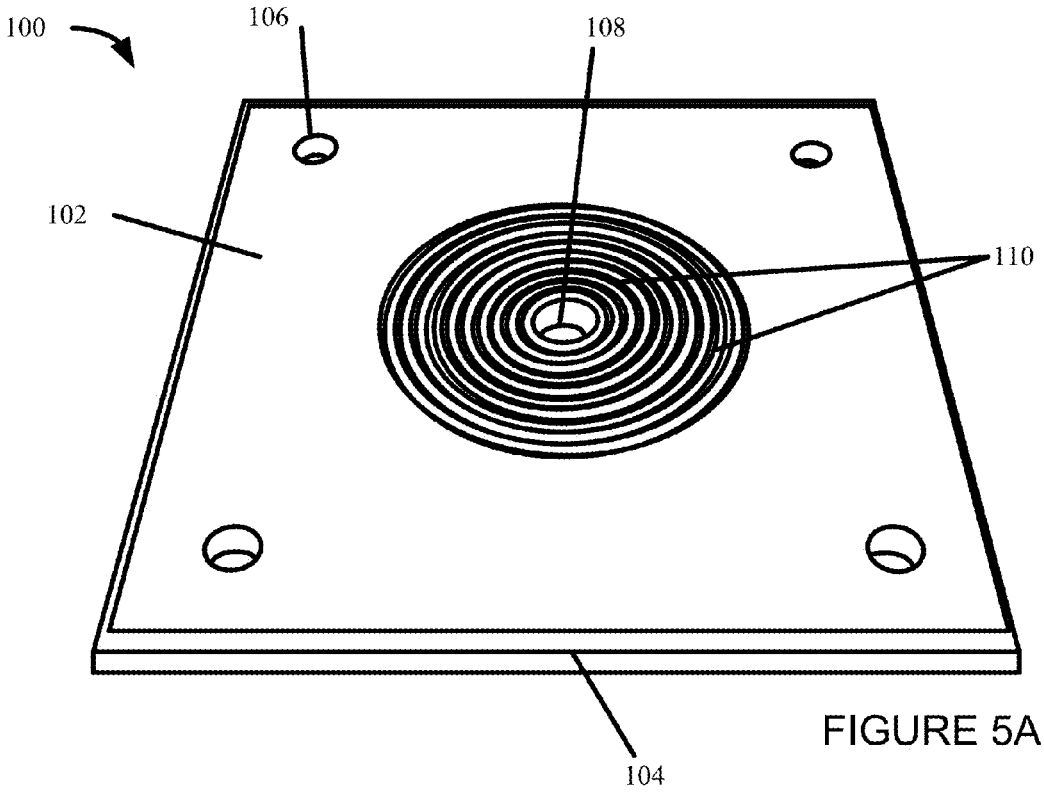
FIGS. 5A and 5B are top and bottom perspective drawings of a planar ion funnel in accordance with an embodiment of the present invention.
Figure 6A:
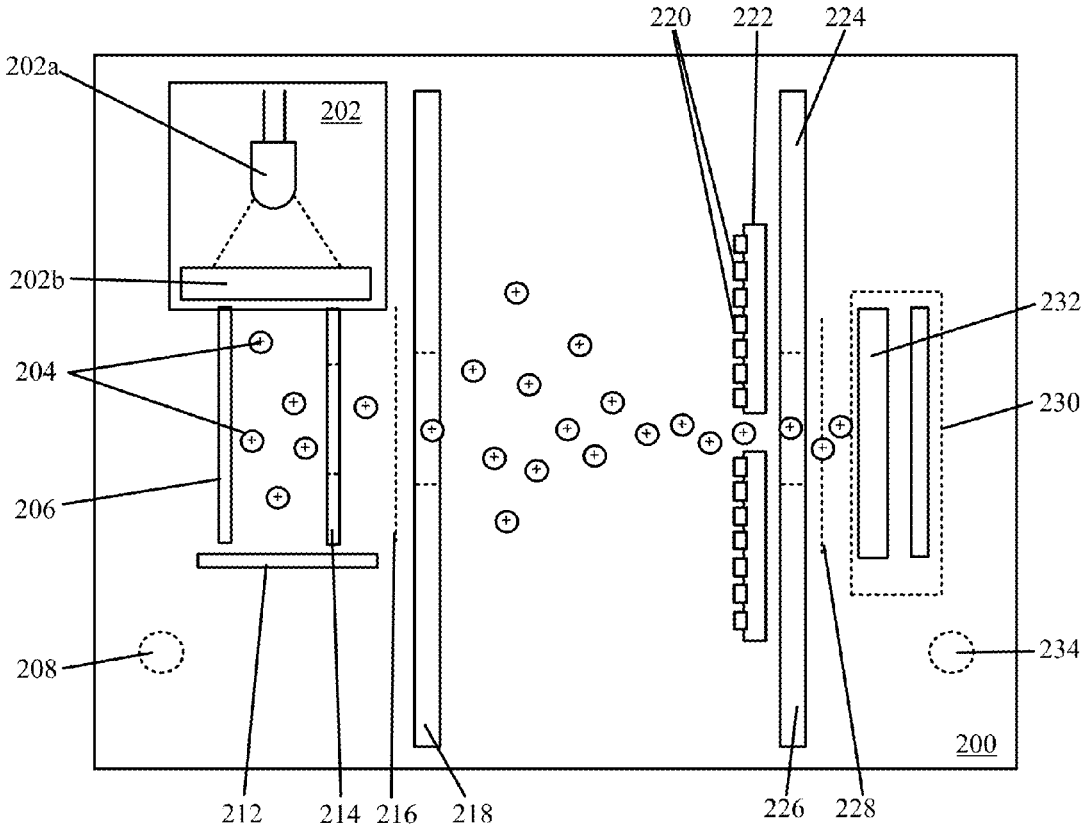
FIG. 6A is a block diagram of an experimental set-up including a planar ion funnel in accordance with an embodiment of the present invention.

In one embodiment, described with more detail with respect to FIGS. 5A and 4B, a voltage divider circuit can be coupled to each of the rings. The voltage divider circuit can be used to apply discrete and different voltages to each ring to generate a voltage gradient that varies from the inner ring 54*b* to the outer ring 54*a*. In one embodiment, a first voltage is applied to the inner ring 54*b* and then different increasing voltages are applied to each of the outer rings until a maximum voltage is reached on the outer ring. The voltage gradient across the rings sets up the electric field that can be use to funnel the ions towards the orifice 52.

In an alternate embodiment, a continuous structure can be formed where the resistance varies from the orifice to the outer perimeter of the ring 54*a*. When a voltage is applied to the structure, the variability in resistance can cause a voltage gradient, from an outer perimeter of the orifice 52 to the outer perimeter of ring 54*b*, to be generated. The voltage gradient that is generated can cause an electric field to be generated that causes an ion funneling effect. An advantage of this approach is that a voltage divider circuit may not be needed.

In yet another embodiment, each of the seven rings can be joined to one another such that current is allowed to flow from ring to ring. The resistance can vary from ring to ring so that a voltage gradient is generated across the rings from the inner ring to the outer ring. For example, the rings can be formed with different widths so that the resistance of each ring varies and a different voltage is set-up on each ring. As another example, the rings can be formed from different materials with different resistances. Again, coupling the rings in this manner may allow a voltage divider circuit not to be used.

In a top portion of FIG. 4, an example of electric equipotential lines 34 that can be generated when power is supplied to the PIF 50 is shown. The equipotential lines extend above a top surface of the PIF 50. Ions 32 are introduced in a direction 30 that is primarily perpendicular to a top surface of the PIF 50. As described above with respect to FIG. 2, the ions may be generated in an ion source portion of a mass spectrometer.

In other embodiments, the ions can be introduced in a non-perpendicular orientation to the top surface of the PIF 50. For example, the ions can be generated and introduced in a direction that is parallel to the top surface of the PIF 50. The PIF can be configured such that a vortex-like electric field is generated that causes the ions to flow through the orifice like water draining from a bath tub.

At introduction, the ions 32 are spread out over a radial distance as measured from center axis 40 which passes through a center of the orifice 52 in the PIF 50 than the radius of orifice 52. In accordance with the electric field that is generated as the ions move toward a top surface of the planar ion funnel 50, the ions are also drawn towards the center axis 40 and towards the orifice 52. The ions exit the orifice in a direction that is proximately aligned with arrow 36, which is parallel to the center axis 40.

One effect of the PIF 50 can be to increase the flux of ions through the orifice 52. In the absence of the electric field 50, the ions at a radius greater than the maximum radius of the orifice 52 that traveling towards the PIF are blocked by the solid portion of the PIF. When the PIF 50 is activated, ions are drawn towards the orifice 52 and the ion flux is increased. In the case of mass spectrometry, the narrower beam of ions can be more suitable for processing in the mass analyzer than a wider beam of ions. Further, the higher flux of ions can increase the sensitivity of the instrument.

In an alternate embodiment, as described above, the planar ion funnel can be configured to disperse a beam of ions. For instance, a beam of ions can be aimed towards the orifice 52 in the PIF. The beam of ions may be narrower than the orifice. The PIF 50 can be configured to generate an electric field such that as the ions pass through the orifice 52, the beam of ions is pulled away from the centerline 40. As an example, the polarity that is used on the PIF 50 to draw the ions towards the orifice can be reversed to cause the ions to move away from the centerline. The rate of movement away from the centerline is greater than the natural dispersion that may occur in the absence of the electric field. The ability to control dispersion of a beam of ions can be useful in some applications, such as but not limited to mass spectrometry.

Next, a few examples of voltage distributions are described with respect to the design in FIG. 4, which includes seven rings. In particular, different voltage distributions are described that can be used for concentrating or dispersing negative or positive ions. The examples are provided for illustrative purposes and are not meant to be limiting.

As a first example, to cause positive ions to be drawn towards and through the orifice of the PIF, the voltages from the inner (smallest) ring to the outer ring can be ten, twenty, forty, eighty, one hundred sixty, three hundred twenty and six hundred forty Volts, respectively. As a second example to cause positive ions passing through the orifice in the PIF to be dispersed after passing through the orifice, the voltages from the inner (smallest) ring to the outer ring can be negative ten, negative twenty, negative forty, negative eighty, negative one hundred sixty, negative three hundred twenty and negative six hundred forty Volts, respectively. As a third example, to cause negative ions to be drawn towards and through the orifice of the PIF, the voltages from the inner (smallest) ring to the outer ring can be negative ten, negative twenty, negative forty, negative eighty, negative one hundred sixty, negative three hundred twenty and negative six hundred forty Volts, respectively. As a fourth example to cause negative ions passing through the orifice in the PIF to be dispersed after passing through the orifice, the voltages from the inner (smallest) ring to the outer ring can be ten, twenty, forty, eighty, one hundred sixty, three hundred twenty and six hundred forty Volts, respectively.

For a PIF with a fixed voltage distribution, the dispersion or concentration effects can be caused by reversing the polarity of the device, i.e., the dispersion effect is caused when the device is operated in a first polarity and the concentration effect is caused when the device is operated in a second polarity opposite the first polarity.

In some embodiments, it may be desirable to use different voltage distributions depending on whether the PIF is used for concentrating ions or dispersing ions. For instance in dispersion applications, it may be desirable to use a steeper gradient because the ions passing through the orifice have only a small velocity component that is perpendicular to their general direction of movement. Thus, the examples provided in the previous paragraph are for the purposes of illustration only and are not meant to be limiting.

In the example above, DC voltages are described. In alternate embodiments, an RF voltage can be applied to the PIF. For example, a sinusoidal RF voltage can be applied to each ring. The amplitude of the RF voltage and the phase of the voltage can vary from ring to ring. For instance, the phase of the RF voltages may vary by 180 degrees from ring to ring.

In FIG. 4, a single PIF is shown. In other embodiments, it may be desirable to use multiple PIFs in a single device. For instance, a first PIF in an instrument can be used for concentrating ions whereas a second PIF can be used for dispersing ions. In general, one or more PIFs can be utilized in an instrument for ion control purposes where each of the one or more PIFs can be used for concentrative or dispersive purposes.

In a particular embodiment, the two PIFs can be integrally formed with one another. For example, one side of the PIF can include a first structure, such as a first ring structure, for drawing ions towards the PIF and through an orifice in the PIF while an opposite side of the PIF can include a second structure, such as a second ring structure, for dispersing the ions after they have passed through the orifice. An insulator can be disposed between the two sides to isolate the electric fields that are generated on each side of the device from one another.

Figure 5B:
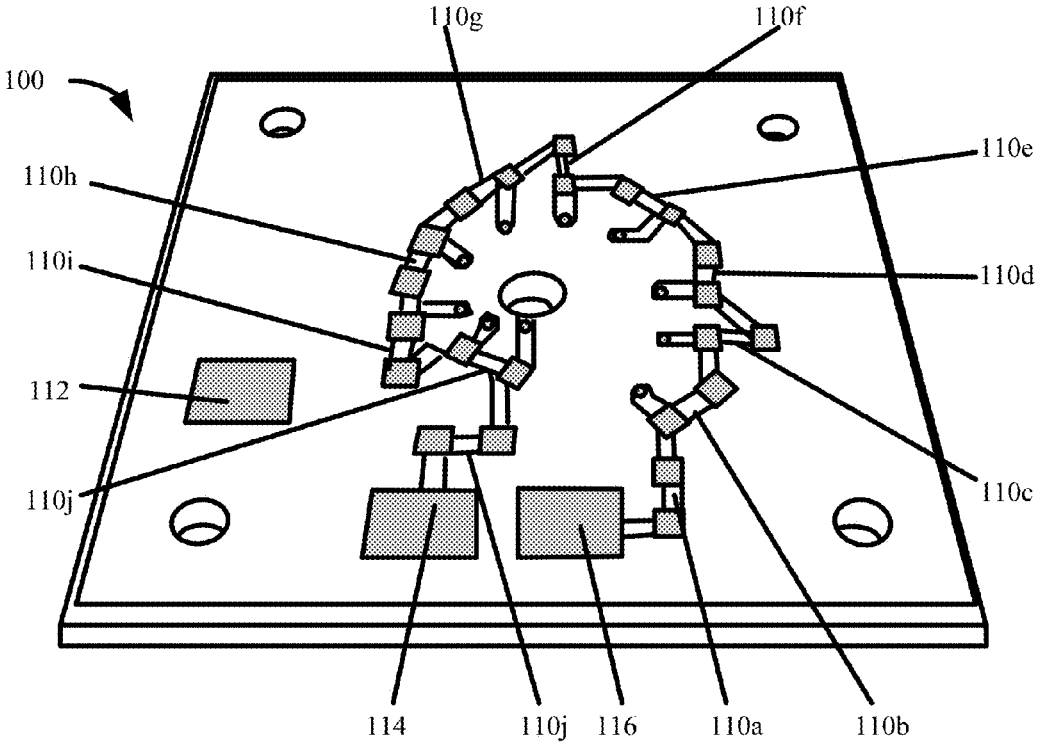

Next with respect to FIGS. 5A, 5B, 6A and 6B one embodiment of a PIF, an experimental set-up for testing the PIF and test results demonstrating functions of the PIF are described. FIGS. 5A and 5B are top and bottom perspective drawings, respectively of a planar ion funnel 100. To provide the PIF 100, a conductive layer 102 is deposited on substrate 104. The conductive layer 102 extends nearly to the edge of the substrate 102. In one embodiment, the substrate can be a material used for a printed circuit board.

In this example, the substrate is a square with a side length of about 3.5 cm. PIFs can be manufactured that are larger or smaller in dimension and this example is provided for the purposes of illustration only. Five holes have been created through the conductive layer 102 and the substrate 104. The outer holes, such as 106, are used to mount the PIF 100 to an experimental set-up (see FIG. 6A). The inner hole 108 provides the orifice that receives ions that are funneled toward the PIF 100. The diameter of the inner hole is about 3 mm.

A structure used to generate an electric field for generating the funneling affect is formed in the conductive layer 102. In this example, the structure is formed by removing circular portions of the conductive layer in the substrate such that eleven discrete rings 110 are formed. Again the number of rings is for the purpose of illustration only. In other embodiments, manufacturing techniques can be used to form this type of structure and this example is provided for illustrative purposes only. For instance, rather than removing material from a conductive layer to generate the rings, the rings can be individually formed on the substrate 104.

As illustrated with respect to FIG. 5B, which shows the bottom side of the PIF, the rings are coupled to a voltage divider circuit 116. The voltage divider circuit causes a discrete and different voltage to be generated on each of the rings when power is applied. Elements 110*a*-110*i* show portions of the circuit associated with each of the nine respective rings. Element 112 represents a ground plane and element 114 represents a ground for the device. In operation, the PIF can be coupled to a power source and power can be applied using the ground 114 to generate the different voltages on each of the rings.

FIG. 6A is a block diagram of an experimental set-up 200 including a planar ion funnel. The set-up 200 includes a mechanism 202 for generating a broad beam of electrons. In this example, the mechanism is an MCP (Micro-Channel Plate) electron gun. The MCP electron gun includes an ultraviolet light source 202*a* that impinges upon one side of a MCP 202*b*.

In response to the MCP receiving the light on side, electrons are emitted on the other side of the plate 202*b*. The area of MCP generating electrons is expected to be the same area where the ultraviolet light impinges on the other side of the MCP. Thus by controlling the area of illumination on MCP, the electron beam can be controlled.

The electrons are confined in a source region between plates 206, 212 and 214. Plate 214 can be charged such that the electrons are drawn toward the plate 212. A neutral gas is introduced via gas inlet 208 and enters the source region. The excess electrons generated from the ionization mechanism 202 impact the neutral gas components causing ions 204 to be formed. The ions 204 travel through an orifice in plate 214, through grate 216 and then through an orifice in flange 218. The grate 216 can be provided to prevent voltage spillover generated in the ion source region. Further, a potential can be applied to the grate 216 that causes the ions to be drawn towards the grate and then through the orifice in flange 218. Alternatively, the potential of 206, 212 and 214 can be raised in order to increase the relative potential energy of the ions created and can be used to pull these ions through the orifice of 216 and 218 to enter the PIF region.

A PIF 212 is positioned between the two flanges 218 and 224. In this example, the distance between the flanges 218 and 224 is about five centimeters. The PIF 50 includes a concentric ring structure 220. The arrangement of the rings is similar to the design shown in FIGS. 5A and 5B. In operation, the PIF 50 is coupled to a power source. When power is supplied, an electric field is generated that causes ions to be pulled towards the PIF 220 and funneled through the orifice in the PIF. The funneling effect is illustrated in FIG. 6A.

After passing through the orifice in the PIF, the ions pass through an orifice in the flange 224 and a metal grate 228. Next, the ions impinge on a detector 230 where the ions that hit the detector 230 and generate an electron current. The detector 230 includes a micro-channel plate that acts as a current amplifier. The output from the detector 230 can be coupled to a data analysis mechanism that allows recording the ion flux impacting the detector (e.g., see FIG. 6B). An ion gauge 234 is provided for measuring the pressure of the set-up 200.

In some embodiments, a mass analyzer can be disposed between the metal grate 228 and the detector 230. The mass analyzer can include structures for trapping ions with a particular mass to charge ratios or ions within a particular mass to charge ratio range. In one embodiment, the structures can be a hyperbolic mass filter/trap. After particular ions are trapped in the mass analyzer, the trapped ions are discharged from the mass analyzer and towards the detector 230. In one embodiment, the ions can be discharged in order according to their mass to charge ratio.

Figure 6B:
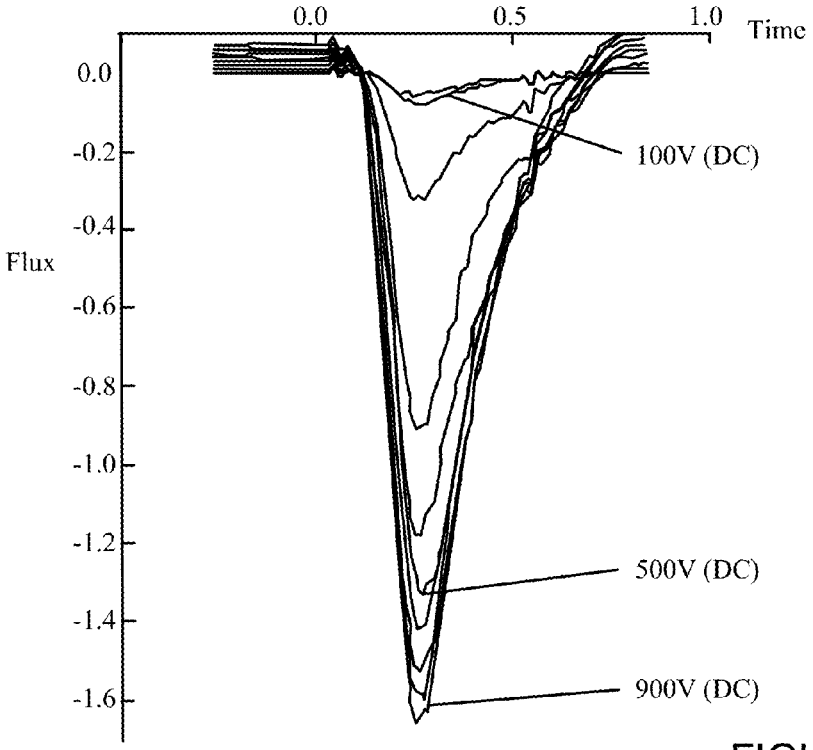
FIG. 6B is a plot of flux versus time when different voltages are applied to the planar ion funnel shown in the experimental of FIG. 6A.

FIG. 6B is a plot of flux versus time when different voltages are applied to the planar ion funnel shown in the experimental set-up of FIG. 6A. The plot shows ion flux as a function of the voltage that is applied to the PIF. The flux plots show that as the voltage is increased to the PIF the ion flux impacting the detector is increased. This result is an indication that the PIF is generating an electric field that is funneling ions towards the detector.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, CD-ROMs, DVDs, magnetic tape and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of several particular embodiments, there are alterations, permutations, and equivalents, which fall within the scope of these general concepts. It should also be noted that there are many alternative ways of implementing the methods and apparatuses of the present embodiments. It is therefore intended that the following appended claims be interpreted as including all such alterations, permutations, and equivalents as fall within the true spirit and scope of the described embodiments.

What we claim is:

1. A planar device for ion control in a low pressure environment comprising: a substantially planar substrate; a conductive layer formed on the planar substrate; an orifice passing through the conductive layer and the planar substrate for receiving ions; a structure for generating an electric field, said structure formed in the conductive layer in an area surrounding the orifice such that when a voltage is applied to the structure the electric field is generated that extends above a top surface of the structure that either funnels ions in a space above the top surface towards and through the orifice or disperses the ions that pass through the orifice as the ions move away from the top surface; and connectors configured to receive power for supplying a voltage to the structure to generate the electric field, wherein an entirety of the planar device lies substantially within a single plane.

2. A planar ion funnel for ion control in a low pressure environment comprising: a substantially planar substrate; a conductive layer formed on the planar substrate; an orifice passing through the conductive layer and the planar substrate for receiving ions; a structure for generating an electric field including a plurality of concentric rings formed in the conductive layer that surround the orifice such that when a voltage is applied to the structure the electric field is generated that extends above a top surface of the structure that funnels ions towards and through the orifice; connectors configured to receive power for supplying a voltage to the structure to generate the electric field; and a voltage divider circuit for providing a different portion of the supplied voltage to each of the plurality of concentric rings, wherein an entirety of the planar ion final is substantially planar-shaped, the planar ion funnel.

3. The device of claim 1, wherein an insulative material is used for the substrate that substantially reduces the electric field that passes through the substrate.

4. The device of claim 1, wherein an outer perimeter of the orifice is circular.

5. The device of claim 1, wherein an outer perimeter of the area including the structure that surrounds the orifice is circular.

6. The device of claim 1, wherein when the voltage is applied to the structure, the voltage increases from an outer perimeter of the orifice to an outer perimeter of the area including the structure that surrounds the orifice.

7. The device of claim 1, wherein the structure is formed with a resistance that increases from an outer perimeter of the area including the structure that surrounds the orifice to an outer perimeter of the orifice such that when the voltage is applied to the structure a voltage gradient is generated where a minimum voltage occurs near the outer perimeter of the orifice and a maximum voltage occurs near the outer perimeter of the area, said voltage gradient generating the electric field.

8. The device of claim 1, wherein the power is DC power.

9. The device of claim 1, wherein the structure includes a plurality of discrete concentric rings.

10. The device of claim 9, further comprising a voltage divider circuit so that a discrete and different voltage is applied to each of the plurality of concentric rings.

11. The device of claim 1, wherein the structure is configured such that a minimum voltage is applied to the innermost of the plurality of concentric rings and a maximum voltage is applied to the outermost of the plurality of concentric rings.

12. The device of claim 1, wherein the device is formed on a printed circuit board.

13. The device of claim 1, wherein the device is formed on a silicon wafer as a part of a microelectromechanical system.

14. The device of claim 1, wherein energy of the ions is between about 1 and 5 Electron Volts.

15. The device of claim 1, wherein the power is RF power.

16. The device of claim 15, wherein RF power is applied with different phases to different portions of the structure.

17. The device of claim 1, wherein the ions are negative ions.

18. The device of claim 1, wherein the ions are positive ions.

19. The device of claim 1, wherein when the voltage is applied with a first polarity the electric field is generated that extends above the top surface of the structure that funnels ions in a space above the top surface towards and through the orifice and when the voltage is applied with a second polarity the electric field is generated that extends above the top surface of the structure that disperses the ions that pass through the orifice as the ions move away from the top surface.

20. A planar ion funnel for ion control in a low pressure environment comprising:

a substantially planar substrate;

a conductive layer formed on the planar substrate;

an orifice passing through the conductive layer and the planar substrate for receiving ions;

a structure for generating an electric field including a plurality of concentric rings formed in the conductive layer that surround the orifice such that when a voltage is applied to the structure the electric field is generated that extends above a top surface of the structure that funnels ions towards and through the orifice;

connectors configured to receive power for supplying a voltage to the structure to generate the electric field; and a voltage divider circuit for providing a different portion of the supplied voltage to each of the plurality of concentric rings.

21. A planar ion funnel for ion control in a low pressure environment comprising: a substantially planar substrate; a conductive layer formed on the planar substrate; an orifice passing through the conductive layer and the planar substrate for receiving ions; a structure for generating an electric field including a plurality of concentric rings formed in the conductive layer that surround the orifice such that when a voltage is applied to the structure the electric field is generated that extends above a top surface of the structure that disperses the ions that pass through the orifice as the ions move away from the top surface; connectors configured to receive power for supplying a voltage to the structure to generate the electric field; and a voltage divider circuit for providing a different portion of the supplied voltage to each of the plurality of concentric rings, wherein an entirety of the planar ion final is substantially planar-shaped, the planar ion funnel.

* * * * *